United States Patent [19]

Jastrzebski

[11] 4,015,377

[45] Apr. 5, 1977

[54] COLLAPSIBLE MULTILEVEL BUILDING

[76] Inventor: Andrzej Jastrzebski, 40, rue des Echevins B, Brussels, Belgium

[22] Filed: Dec. 29, 1975

[21] Appl. No.: 645,312

Related U.S. Application Data

[63] Continuation of Ser. No. 497,079, Aug. 13, 1974, now abandoned.

[52] U.S. Cl. ..... 52/66; 52/73; 52/79.2; 52/236.4; 52/236.8

[51] Int. Cl.[2] ..... E04B 1/344

[58] Field of Search ..... 52/66, 67, 64, 79, 73, 52/71, 185, 184, 191, 236; 296/23 G, 23 F, 27

[56] References Cited

UNITED STATES PATENTS

| | | | |
|---|---|---|---|
| 3,009,166 | 11/1961 | Sears | 52/66 X |
| 3,100,915 | 8/1963 | Pennington et al. | 52/185 X |
| 3,278,221 | 10/1966 | Jaulmes | 296/27 |
| 3,397,007 | 8/1968 | Scheid | 296/27 |
| 3,434,166 | 3/1969 | Clymer | 296/27 |
| 3,490,807 | 1/1970 | Sare | 52/64 X |
| 3,517,962 | 6/1970 | Bassett | 52/64 X |
| 3,593,471 | 7/1971 | Fields | 52/66 |
| 3,707,811 | 1/1973 | Hampson | 52/64 |
| 3,832,811 | 9/1974 | Briel, Jr. | 52/69 |
| 3,849,952 | 11/1974 | Hanaoka | 52/79 |
| 3,941,415 | 3/1976 | Cooper | 52/66 X |

FOREIGN PATENTS OR APPLICATIONS

| | | | |
|---|---|---|---|
| 269,000 | 2/1964 | Australia | 52/79 |
| 1,113,661 | 4/1956 | France | 52/185 |
| 1,509,042 | 12/1967 | France | 52/79 |
| 822,562 | 10/1959 | United Kingdom | 296/27 |

*Primary Examiner*—Leslie Braun
*Attorney, Agent, or Firm*—Cushman, Darby & Cushman

[57] ABSTRACT

There is described a collapsible building formed by at least one unit comprising at least one level, in which the floor and the ceiling of a unit are hinged together by means of braces, the ends of which on the one hand to upturned floor edges and on the other hand, to downturned ceiling edges, so as to be swingable in a vertical plane.

3 Claims, 5 Drawing Figures

COLLAPSIBLE MULTILEVEL BUILDING

This is a continuation of application Ser. No. 497,079 filed Aug. 13, 1974 now abandoned.

This invention relates to a collapsible building formed by at least one unit which comprises at least one level.

The invention has for an object to provide not only a collapsible building or house which can be stocked or conveyed with a rather small volume with respect to that volume finally occupied by the building when it is erected, but also a building or house which can permanently be fitted with the basic equipment thereof which is work-assembled when manufacturing the unit comprising said building.

The invention has not only for object to provide separate units, but also to allow assembling said separate units into a fixed skeleton or structure.

For this purpose the floor and the ceiling of a unit are hinged together by means of braces the ends of which are hinged on the one hand to upturned floor edges and on the other hand, to downturned ceiling edges, so as to be swingable in a vertical plane.

In an advantageous embodiment of the invention, the brace ends are hingedly mounted on the upturned floor edges on the one hand and on the downturned ceiling edges on the other hand, in such a way that when the braces lie in a vertical position, the one end of a level ceiling overhangs the corresponding floor end of the same level and when the braces lie in a horizontal position, the ceiling of a level lies precisely above the floor of said level, the building then being in the shape of a parallelepiped with continuous and closed end and side walls.

In a particular embodiment, the braces swing in a plane in parallel relationship with the main axis of said unit.

Other details and features of the invention will stand out from the description given below by way of non limitative example and with reference to the accompanying drawings, in which.

In the various figures, the same reference numerals pertain to similar elements.

The collapsible building shown in the figures is of a type comprising a two-level unit. It should be clearly understood that the term "building" also covers the notion of sheltered volume to be used for other purposes than a house proper, for instance for stocking.

Figure 1:
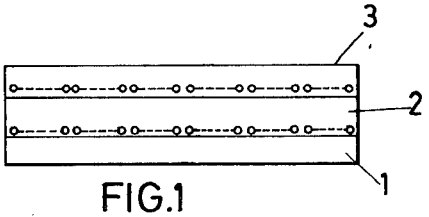
FIG. 1 is a diagrammatic showing of a two-level building or house, in the stockage or conveying condition.
Figure 2:
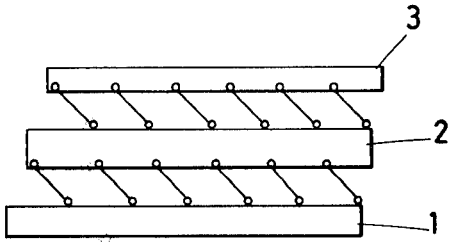
FIG. 2 is a diagrammatic showing of the building shown in FIG. 1 being mounted.

In FIG. 1 which is a diagrammatic showing of the invention, the building or house has been shown in that condition where the unit lies in collapsed condition. The element 1 comprises the lower level floor, the element 2 comprises both the lower level ceiling and the upper level floor, while the element 3 comprises the upper level ceiling.

Figure 3:
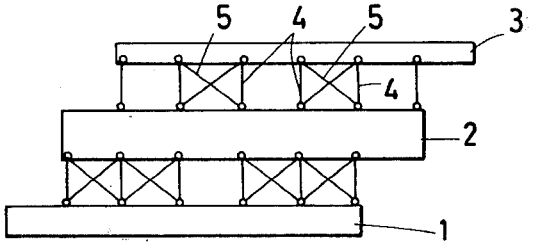
FIG. 3 is a diagrammatic showing of the building shown in FIGS. 1 and 2, as mounted.
Figure 5:
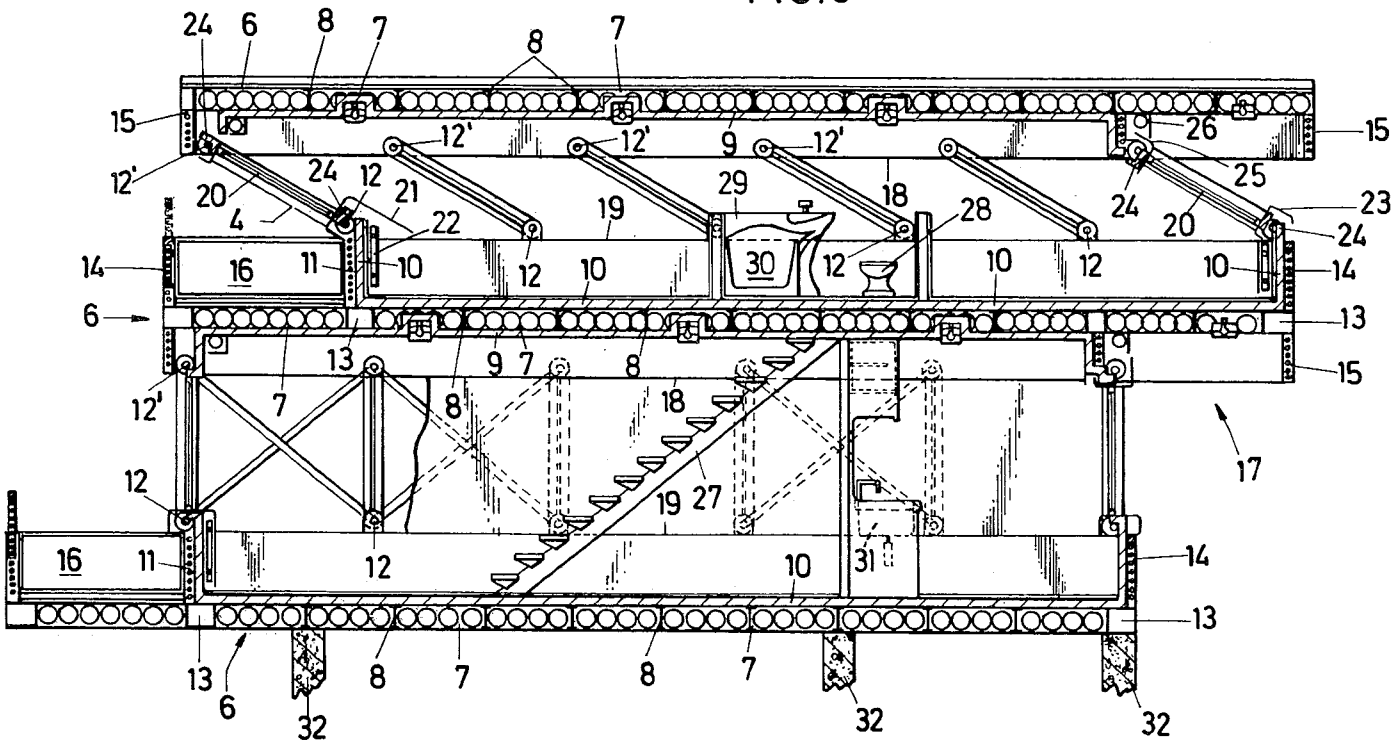
FIG. 5 is a lengthwise section on a larger scale, partly broken away, of a building according to the invention.

The braces 4 have also been shown diagrammatically while the sway-bracing elements 5 comprising a trelliswork required for locking the elements relative to one another, are visible but in FIGS. 3 and 5.

Actually every element 1, 2 and 3 essentially comprises a bidirectional box structure 6 which is made according to known technics and which is comprised of open-work cross-members 7 and 8 which cross at right angle to one another. An insulation layer 9 is provided to form the ceiling covering and an insulation layer 10 with a different nature comprises the flooring and the covering of edges 11 extending the floor of each unit. Each vertical edge 11 on which is mounted a hinge pivot 12 for a brace 4, is made fast to the floor structure in line with a three-dimension beam 13. The same holds true for those vertical edges 14 which comprise the end walls.

All of the hinge pivots 12 are arranged horizontally on that edge joining a level floor, while all of the pivots 12' are arranged horizontally on that edge joining the ceiling of the same level. The spacing between the axes of two pivots connected by a brace 4 is such that in the collapsed or horizontal position of said braces, the front vertical edges 15 joining that recessed edge forming a lintel for a level, will come to lie in vertical alinement with those front vertical edges 14 joining the floor of one and the same level.

When the braces are collapsed to the horizontal condition, the unit forms a parallelepiped with continuous and closed front and side walls. The unit can be conveyed in such condition and a plurality of units can be stocked one upon another and one beside the other.

When the braces lie in a vertical position, the sway-bracing elements 5 form a trellis-work which imparts the required rigidity to the whole arrangement. Said sway-bracing elements 5 are separate elements which can be made in any suitable known way as flat irons or cables in tensile stress.

Figure 4:
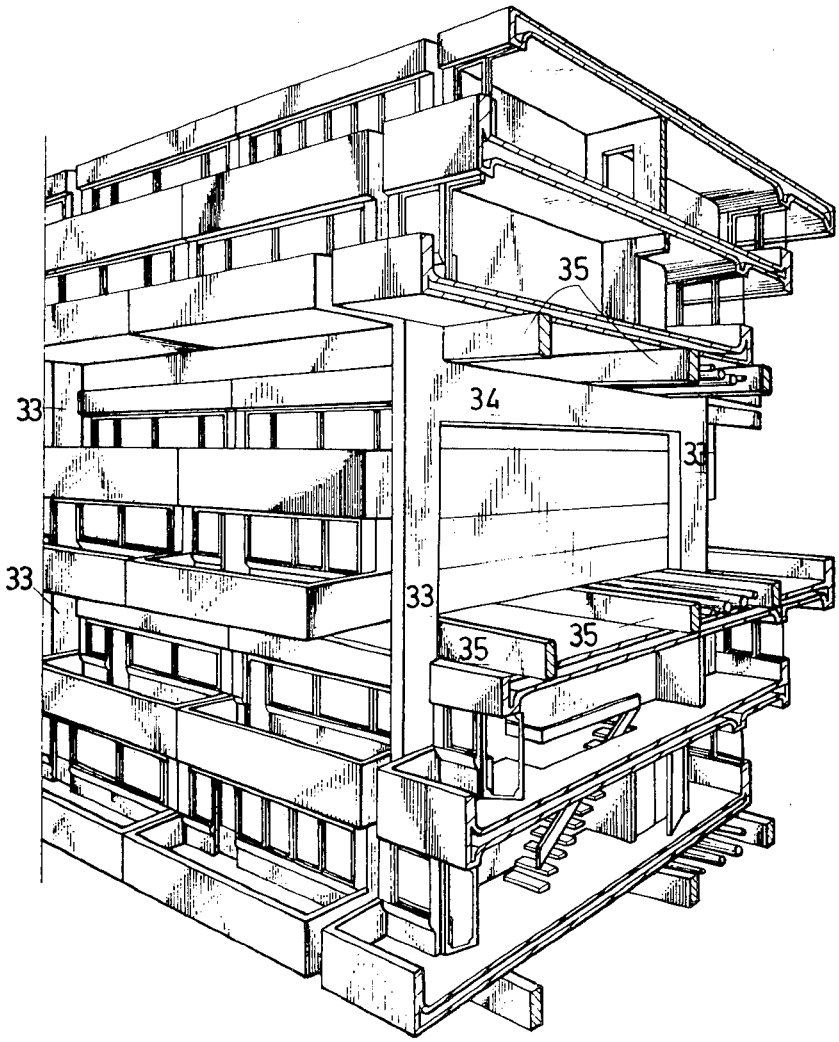
FIG. 4 is a perspective view of an arrangement of a plurality of buildings mounted inside a fixed skeleton or structure.

At the front ends thereof, each unit comprises either a gallery 16 or an overhanging roof 17. Every level is to be completed sidewise by additional wall elements which by the assembly come intermediate upper edge 18 and lower edge 19 (FIG. 4). Upturned or downturned edges of one unit extend a unit ceiling or floor. The additional wall elements can be stocked inside each unit and removed therefrom when erecting same.

Those braces mounted on edge 11 and on the one end edge 14 bear frames with glazing 20. At the bottom of said frame bearing the glazing 20 is provided either a cover 21 for a radiator 22, or a protecting cover 23. Said elements are of course provided inside or outside according to the possibilities given by the swinging towards the vertical position of the brace.

On the upper and lower parts of one and the same frame are provided respectively engagement surfaces 24 and 24' which abut the corresponding surfaces either of that insulation layer 9 forming a ceiling, or of that insulation layer 10 which extends vertically from the floor against the vertical walls 11 and 14. A cover 25 can also be provided at the frame top to engage a wall 26 swinging to a vertical position and which is part of the overhanging roof 17.

Stairs 27 hingedly mounted on that floor structure 6 which separates both unit levels, swing down when the unit lies in stocking or conveying condition.

The complete arrangement comprising W-C 28, basin 29 and tub 30, is so located that the discharge water pipes and the ventilating ducts of the hygiene system lie in vertical alinement or substantial vertical alinement with the discharge water pipes and the ventilating ducts of the kitchen the sink 31 of which is visible in FIG. 5.

The above description of a collapsible housing unit according to the invention, sums up in the essential elements absolutely required for the understanding of the system allowing to stock and convey units which are fitted at the outset when being manufactured in the works, with many required apparatus. Said apparatus are notably part of the lighting system, the heating system or the air-conditioning, as well as the insulation for the hygien and domestic equipment and the glazing.

In practical use, a collapsible building with one or two levels can be made fast to a masonry or concrete foundation 32.

It is also possible to arrange a number of units of the above-described type inside a concrete or steel skeleton. Such a solution has been shown in FIG. 4. In FIG. 4, the skeleton uprights or columns are shown in 33 and the cross beams joining said uprights in 34. On the cross beams 34 bear beams 35 supporting the housing units shown in mounted condition.

It must be understood that the invention is in no way limited to the above embodiments and that many changes can be brought therein without departing from the scope of the invention as defined by the appended claims.

For instance the volumes defined according to the invention can be designed in a similar way and have another use, by doing away with those fittings specifically required for a housing unit.

I claim:

1. A collapsible, multistory building structure comprising at least first, second and third platform members each extending in generally horizontal planes, said second platform member being disposed between said first and third platforms, said building structure having wall means between said platform members extending from at least one of said platform members toward an adjacent platform member for providing an enclosed space between said first and second platform members and between said second and third platform members when said building structure is in its collapsed condition, said second platform member having surfaces facing said first and third platform members for forming the floor and ceiling respectively to the enclosed space formed above and beneath said second platform member each of said platform members having generally parallel sides said second platform member having a first set of supporting braces pivotally connected to its sides, said first set extending between said second platform member and said first platform member and being also pivotally attached to said wall means extending therebetween, said second platform member having a second set of supporting braces pivotally connected to its sides said second set extending between said second platform member and said third platform member and being also pivotally attached to said wall means extending therebetween each of said supporting braces being swingable in a vertical plane, a first number of said supporting braces in said first set being connected to one end of said first platform member and extending to said second platform member and pivotally connected thereto at a distance from an end of said second platform member equal to the length of said brace, a first number of said supporting braces in said second set extending from one end of the opposite face of said second platform member to said third platform member and pivotally connected thereto at a distance from an end of said third platform member equal to the length of a said brace, each of said braces in said first and second sets being equally spaced from each adjacent brace whereby said braces allow movement in an angular pivoting fashion between said first, second and third platform members relative to one another and whereby said first, second and third platform members when collapsed, form a parallelepiped shaped unit and when raised establish a stepped relationship between adjacent platforms so that one end of said second and third platform members is cantilevered over at least the next adjacent lower platform member thereby forming an overhanging roof, the opposite end of said second and third platform member being stepped away from and exposing the next lower platform member thereby forming a gallery area in the lower platform member.

2. The building as claimed in claim 1, wherein plumbing utilities are located on at least said first platform and the height of said walls is sufficient to bound a volume large enough to enclose said plumbing utilities when said building is in the collapsed position.

3. A multilevel structure where each level contains a plurality of building units, said multilevel structure includes a support frame network means for providing a plurality of vertically spaced support levels for supporting a plurality of individual building units, wherein each of said plurality of building units comprises a collapsible multistory building comprising at least first, second and third platform members each extending in generally horizontal planes, said second platform member being disposed between said first and third platforms, said building structure having wall means between said platform members extending from at least one of said platform members toward an adjacent platform member for providing an enclosed space between said first and second platform members and between said second and third platform members when said building structure is in its collapsed condition, said second platform member having surfaces facing said first and third platform members for forming the floor and ceiling respectively of the enclosed space formed above and beneath said second platform member each of said platform members having generally parallel sides said second platform member having a first set of supporting braces pivotally connected to its sides, said first set extending between said second platform member and said first platform member and being also pivotally attached to said wall means extending therebetween, said second platform member having a second set of supporting braces pivotally connected to its sides said second set extending between said second platform member and said third platform member and being also pivotally attached to said wall means extending therebetween each of said supporting braces being swingable in a vertical plane, a first number of said supporting braces in said first set being connected to one end of said first platform member and extending to said second platform member and pivotally connected thereto at a distance from an end of said second platform member equal to the length of a said brace, a first number of said supporting braces in said second set extending from one end of the opposite face of said second platform member to said third platform member and pivotally connected thereto at a distance from an end of said third platform member equal to the length of a said brace, each of said braces in said first and second sets being equally spaced from each adjacent brace whereby said braces allow movement in an angular pivoting fashion between said first, second and third platform members relative to one another and whereby said first, second and third platform members when collapsed, form a parallelepiped shaped unit and when raised establish a stepped relationship between adjacent platforms so that one end of said second and third platform members is cantilevered over at least the next adjacent lower platform member thereby forming an overhanging roof, the opposite end of said second and third platform member being stepped away from and exposing the next lower platform member thereby forming a gallery area in the lower platform member.

* * * * *